US008322586B2

(12) United States Patent
Davis

(10) Patent No.: US 8,322,586 B2
(45) Date of Patent: Dec. 4, 2012

(54) HOLSTER AND BELT CLIP ASSEMBLY FOR A BOX CUTTER

(75) Inventor: Raymond E. Davis, Heath, TX (US)

(73) Assignee: ADCO Industries-Technologies, L.P., Dallas, TX (US)

( * ) Notice: Subject to any disclaimer, the term of this patent is extended or adjusted under 35 U.S.C. 154(b) by 1177 days.

(21) Appl. No.: 11/228,915

(22) Filed: Sep. 16, 2005

(65) Prior Publication Data

US 2005/0279787 A1 Dec. 22, 2005

(51) Int. Cl.
*B26B 29/02* (2006.01)
*A45F 5/00* (2006.01)
*B65D 25/52* (2006.01)

(52) U.S. Cl. ..... 224/669; 224/232; 224/269; 224/197

(58) Field of Classification Search ..... 224/669, 224/269, 232, 197; 30/162
See application file for complete search history.

(56) References Cited

U.S. PATENT DOCUMENTS

| | | | | |
|---|---|---|---|---|
| 2,018,149 | A | 10/1935 | Randle et al. | |
| 4,419,794 | A * | 12/1983 | Horton et al. | 24/667 |
| 4,426,779 | A * | 1/1984 | Morgan | 30/138 |
| 4,494,309 | A * | 1/1985 | Gray | 30/151 |
| 4,525,928 | A * | 7/1985 | Foster | 30/158 |
| 4,683,656 | A | 8/1987 | Peyrot et al. | |
| 4,718,586 | A * | 1/1988 | Hagino | 224/666 |
| 4,848,000 | A * | 7/1989 | O'Dell | 30/158 |
| 4,868,985 | A | 9/1989 | Rehm | |
| 5,054,170 | A * | 10/1991 | Otrusina | 24/580.11 |
| 5,255,436 | A * | 10/1993 | Yoshida | 30/151 |
| 5,315,761 | A * | 5/1994 | Norton et al. | 30/162 |
| 5,379,520 | A * | 1/1995 | Collins | 30/162 |
| 5,511,311 | A * | 4/1996 | Collins | 30/162 |
| 5,620,120 | A * | 4/1997 | Tien | 224/199 |
| 5,730,342 | A * | 3/1998 | Tien | 224/271 |
| 5,839,173 | A * | 11/1998 | Otrusina | 24/595.1 |
| 6,000,590 | A | 12/1999 | Allen | |
| 6,105,838 | A * | 8/2000 | Hansen | 224/232 |
| 6,364,182 | B1 | 4/2002 | Hansen | |
| 6,382,481 | B1 | 5/2002 | McIlmoil | |
| 6,427,374 | B1 * | 8/2002 | Vaiani | 42/85 |
| 6,578,745 | B1 * | 6/2003 | Taylor et al. | 224/197 |

(Continued)

FOREIGN PATENT DOCUMENTS

DE 8704973 7/1987

(Continued)

OTHER PUBLICATIONS

Partial European Search Report issued in related European Appl. No. 08153448.9 on Jun. 16, 2008; 4 pages.

(Continued)

*Primary Examiner* — Nathan J Newhouse
*Assistant Examiner* — Lester L Vanterpool
(74) *Attorney, Agent, or Firm* — Fish & Richardson P.C.

(57) ABSTRACT

A holster and belt clip assembly for a box cutter are disclosed. In the holstering system embodiment, a holster releasably retains the box cutter. The holster has a body substantially conforming to the shape of the box cutter, an open top end, and a closed bottom end. A lanyard secures the box cutter to the holster. A belt clip, which is releasably engaged with the holster, mounts the holster to a belt of an operator.

18 Claims, 7 Drawing Sheets

U.S. PATENT DOCUMENTS

| | | | | |
|---|---|---|---|---|
| 6,742,261 | B2 * | 6/2004 | Ho | 30/162 |
| 6,752,299 | B2 * | 6/2004 | Shetler et al. | 224/197 |
| 6,817,499 | B2 * | 11/2004 | Martinez | 224/197 |
| 6,889,879 | B2 * | 5/2005 | Rivera et al. | 224/245 |
| 6,966,519 | B2 * | 11/2005 | Salentine et al. | 242/379 |
| 7,032,791 | B2 * | 4/2006 | Stotts | 224/269 |
| 7,434,316 | B2 * | 10/2008 | Nenadic | 30/143 |
| 2002/0153395 | A1 * | 10/2002 | Martinez | 224/232 |
| 2003/0042348 | A1 | 3/2003 | Salentine et al. | |
| 2003/0106917 | A1 * | 6/2003 | Shetler et al. | 224/197 |
| 2003/0141329 | A1 * | 7/2003 | Huang | 224/197 |
| 2003/0154606 | A1 | 8/2003 | Saunders et al. | |
| 2003/0213823 | A1 * | 11/2003 | Papovitch | 224/254 |
| 2004/0173650 | A1 | 9/2004 | Berns | |
| 2004/0237312 | A1 | 12/2004 | Hernandez et al. | |
| 2005/0072819 | A1 | 4/2005 | Maldonado et al. | |

FOREIGN PATENT DOCUMENTS

| | | |
|---|---|---|
| DE | 20210670 | 9/2002 |
| FR | 2552008 | 3/1985 |

OTHER PUBLICATIONS

European Search Report issued in related European Appl. No. 08153448.9 on Sep. 19, 2008; 9 pages.

* cited by examiner

HOLSTER AND BELT CLIP ASSEMBLY FOR A BOX CUTTER

CROSS-REFERENCE TO RELATED APPLICATIONS

This application discloses subject matter related to the subject matter disclosed in the following commonly owned, co-pending design patent application: "Utility Knife and Holster," filed on Sep. 16, 2005, application Ser. No. 29/238,573, in the name of Raymond E. Davis; which is hereby incorporated by reference for all purposes.

TECHNICAL FIELD OF THE INVENTION

This invention relates, in general, to utility knives or box cutters and, in particular, to a combination box cutter and holster assembly that permits normal use of the box cutter in the workplace while keeping the box cutter in close proximity to the operator for ready use.

BACKGROUND OF THE INVENTION

A utility knife or box cutter is a common tool used in various trades and crafts. The typical box cutter includes a metal or plastic handle with a retractable blade. An operator can manually adjust the extension of the blade and replace the blade when it because dull. While the operator is performing normal work routines the box cutter is not needed in hand, but must be kept close by for ready access when a cutting operation is called for.

By way of example, the operator may alternate between opening boxes and stocking the contents of the boxes. While the operator is stocking the contents of the boxes, the box cutter is not needed but should be kept close at hand. A lost or misplaced box cutter results in lost productivity. Further, a box cutter placed in an inappropriate location, such as on the floor, may be within the reach of unauthorized persons or children. This increases the likelihood of a slip and fall or other personal injury. Accordingly, there is a need for improvements that permit a box cutter to be kept close for ready access when the box cutter is not in use.

SUMMARY OF THE INVENTION

A holstering assembly for a box cutter is disclosed that provides for normal use of the box cutter in the workplace while keeping the box cutter in close proximity to the operator for ready use. In one holstering system embodiment, a holster releasably retains the box cutter. The holster has a body substantially conforming to the shape of the box cutter, an open top end, and a closed bottom end. A lanyard secures the box cutter to the holster and a belt clip, which is releasably engaged with the holster, attaches the holster to a belt of an operator. In other embodiments, the holster has dual coupling studs for left side and right side attachment to a belt clip, a snap-fit detent feature for securing the box cutter in the holster, and a belt clip providing stabilization.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
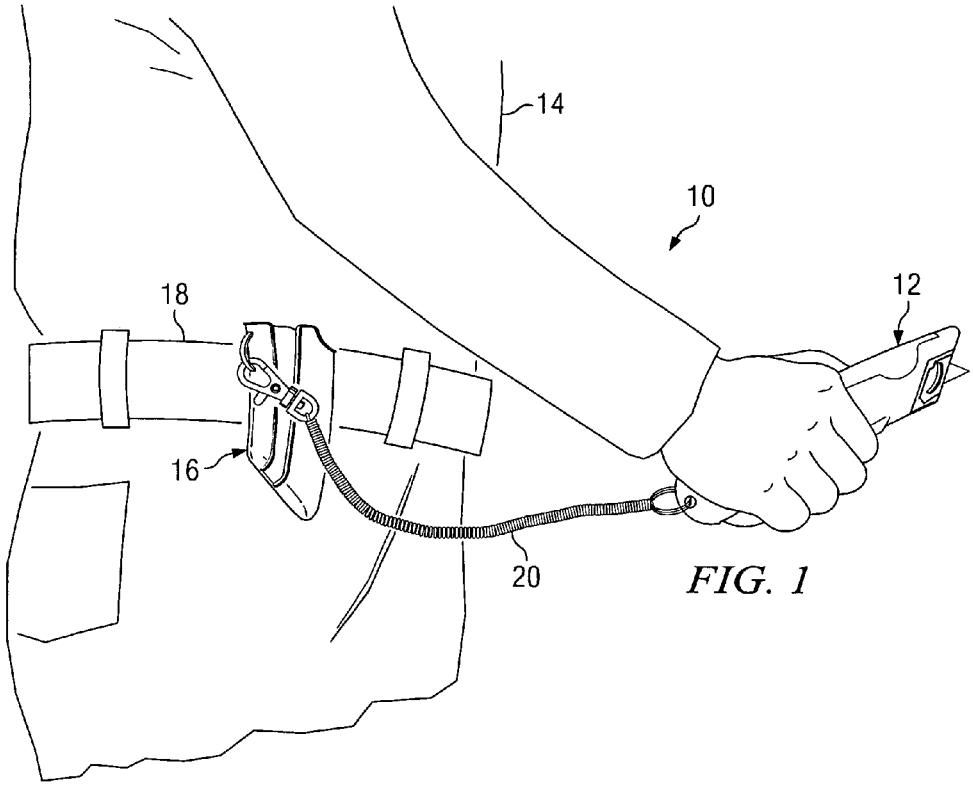
FIG. 1 is a perspective view of one embodiment of a holstering system for a box cutter.

Referring initially to FIG. 1, therein is depicted one embodiment of a holstering system 10 for a utility knife or box cutter 12 being used by an operator 14. The box cutter 12 is designed for cutting corrugated paperboard and other sheet material and hence is ideally suited for slitting the walls of corrugated paperboard boxes and to open cardboard cartons, for example in grocery stores, supermarkets, convenience stores, restaurants and other retail establishments. The box cutter 12 can also be used to safely cut a variety of materials, for example plastic sheeting, floor tiles, linoleum, carpeting, thin wood panels, wall paper, banding straps, tape and plastic sacks containing bulk materials. It should be appreciated that although a particular model of box cutter 12 is depicted throughout the figures, the holstering system presented herein is compatible with any type of box cutter.

A holster 16 is mounted to a belt 18 of the operator 14. A lanyard 20, which is preferably extendable and retractable in length, secures the box cutter 12 to the holster 16. The holster 16 releasably retains the box cutter 12 and, as illustrated, the operator 14 has removed the box cutter 12 from the holster. The box cutter 12, the holster 16, and the lanyard 20 are arranged to prevent the box cutter 12 from falling to the ground when the box cutter 12 is removed from the holster 16.

The holstering system 10 permits normal use of the box cutter 12 in the workplace while keeping the box cutter 12 in close proximity to the operator for ready access. The holster 16 and lanyard 20 prevent the box cutter 12 from becoming lost or misplaced, thereby saving time that would otherwise be used for searching for the box cutter 12. Further, the holstering system 10 prevents the box cutter 12 from falling within the reach of unauthorized persons, children, customers, co-workers, and the like.

Figure 2:
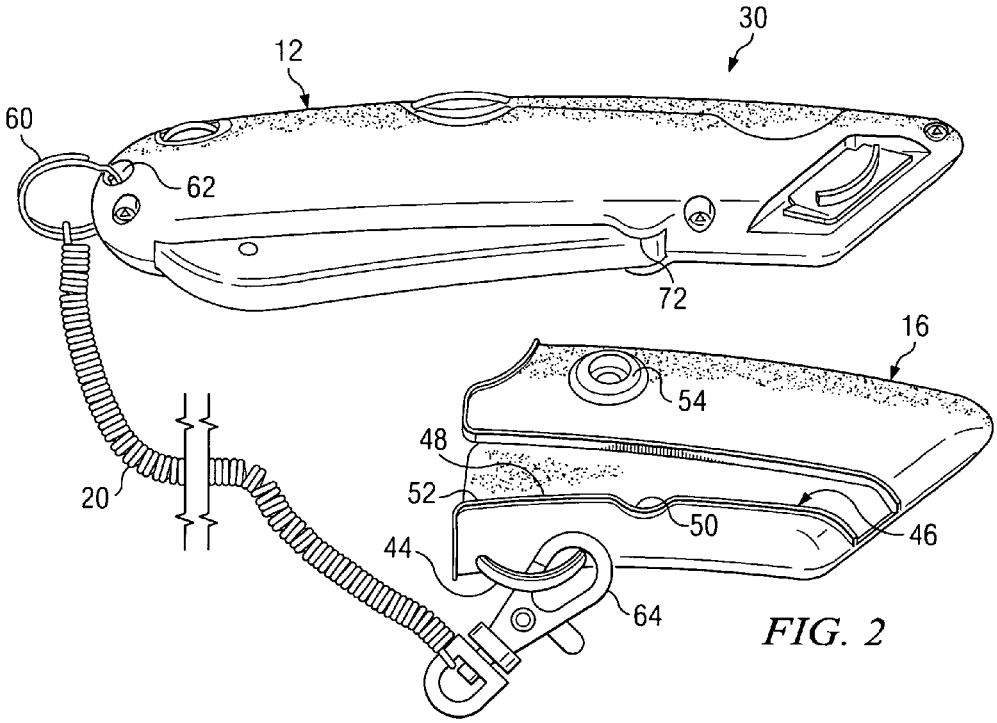
FIG. 2 is a perspective view of one embodiment of a holster assembly for use in conjunction with the box cutter.

FIG. 2 depicts one embodiment of a holster assembly 30 for use in conjunction with the box cutter 12. In one embodiment, the holster assembly 30 includes the holster 16, the lanyard 20, and a belt clip 32 which slidably engages the holster 16 and mounts the holster 16 to the belt. The holster 16 includes a body 34 having two sidewalls 36 and 38, an open top end 40, and a bottom end 42. The body 34 substantially conforms or is adapted to the shape of the box cutter 12, and sidewalls define a pocket for receiving a box cutter. A loop 44 is formed at the interface of the sidewalls 36 and 38. An elongated slot 46 is formed in the sidewall 36. A shoulder 48 and detent 50 are formed on an edge portion 52 of the elongated slot 46.

Coupling studs 54 and 56 are provided on sidewalls 36 and 38, respectively. The belt clip 32 may slidably engage either of the coupling studs 54 and 56. This ambidextrous dual coupling stud arrangement permits the holster 16 to be worn on each of the left and side sides of the operator 14. Preferably, the holster 16 and belt clip 32 are molded of a stiff but resilient material such as a plastic or polymer. Further, in a preferred embodiment, the holster 16 and belt clip 32 are each unitarily formed.

In one implementation, the lanyard 20 has a small diameter and low profile so as not to be bulky or uncomfortable to the operator 14. A ring 60 on one end of the lanyard 20 passes through an eyelet 62 formed in the box cutter 12 to couple the lanyard 20 to the box cutter 12. On the other end, a swivel device 64 mates with the loop 44 to connect the lanyard 20 to the holster 16, thereby connecting the box cutter 12 to the holster 16.

The swivel device 64 permits the lanyard 20 and box cutter 12 to rotate independently of the holster 16. This reduces the number of bends experienced by the lanyard 20 during repeated use and, over time, reduces the wear and tear on the holster assembly 30. Additionally, the swivel device 64 of the lanyard 20 permits the box cutter to be easily disconnected and reconnected from the holster 16 if the need should arise. It should be appreciated that although the ring 60 is depicted as connecting the lanyard 20 to the box cutter 12 and the swivel device 64 is depicted as connecting the lanyard 20 to the holster 16, other arrangements are possible. By way of example, the swivel device 64 may connect the lanyard 20 to the box cutter 12.

Figure 3:
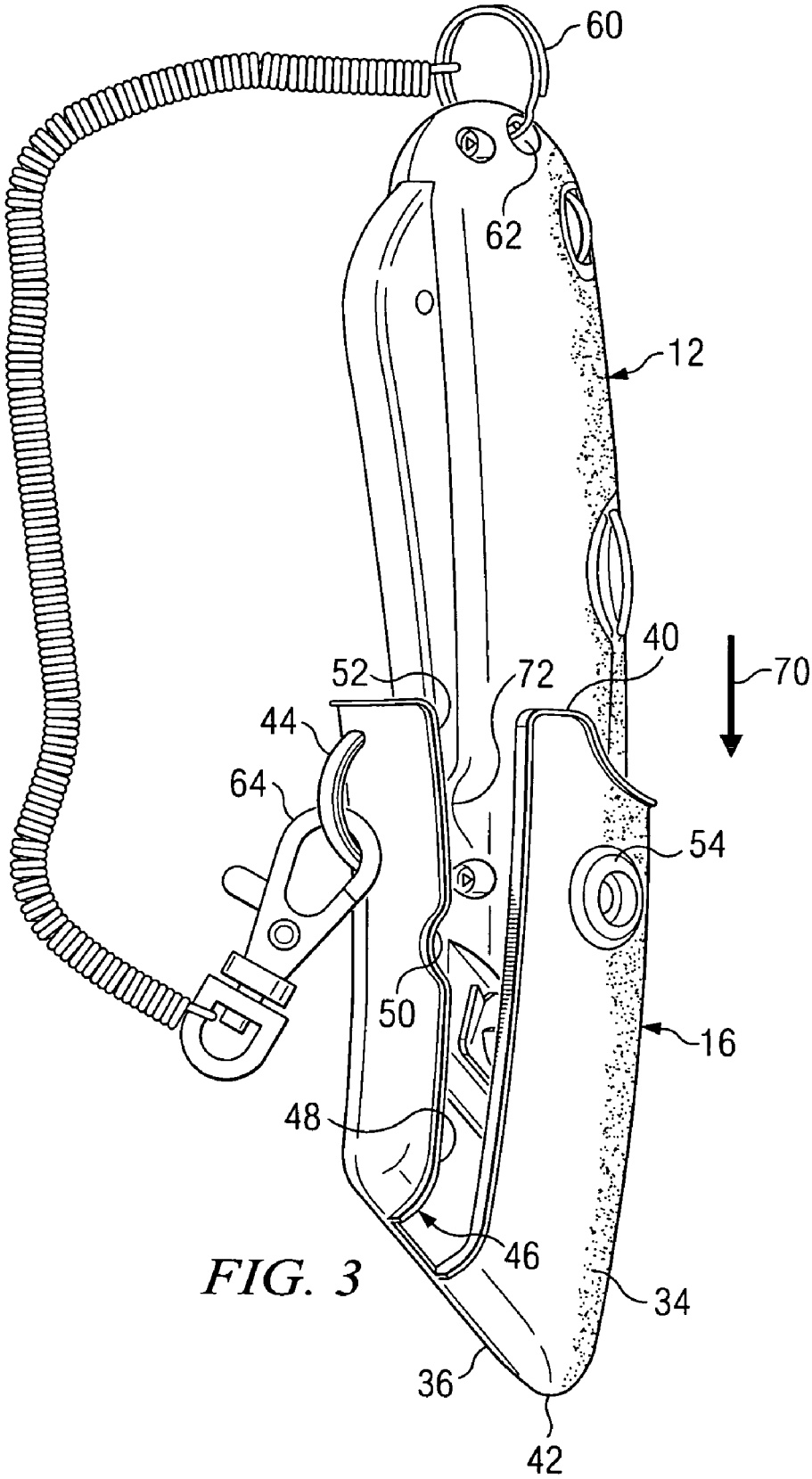
FIG. 3 is a perspective view of the holster assembly during insertion of the box cutter into the holster.

FIG. 3 depicts the holster assembly 30 during insertion of the box cutter 12 into the holster 16. The holstering system 10 presented herein provides for a sliding interference engagement with the box cutter 12 during insertion of the box cutter 12 into the holster 16. Additionally, the sidewalls of the holster are made of resilient, deflectable polymer material that provides for yieldably opposing retraction of the box cutter 12 from the holster 16 to ensure the box cutter 12 remains holstered until removed by the operator 14.

Figure 4:
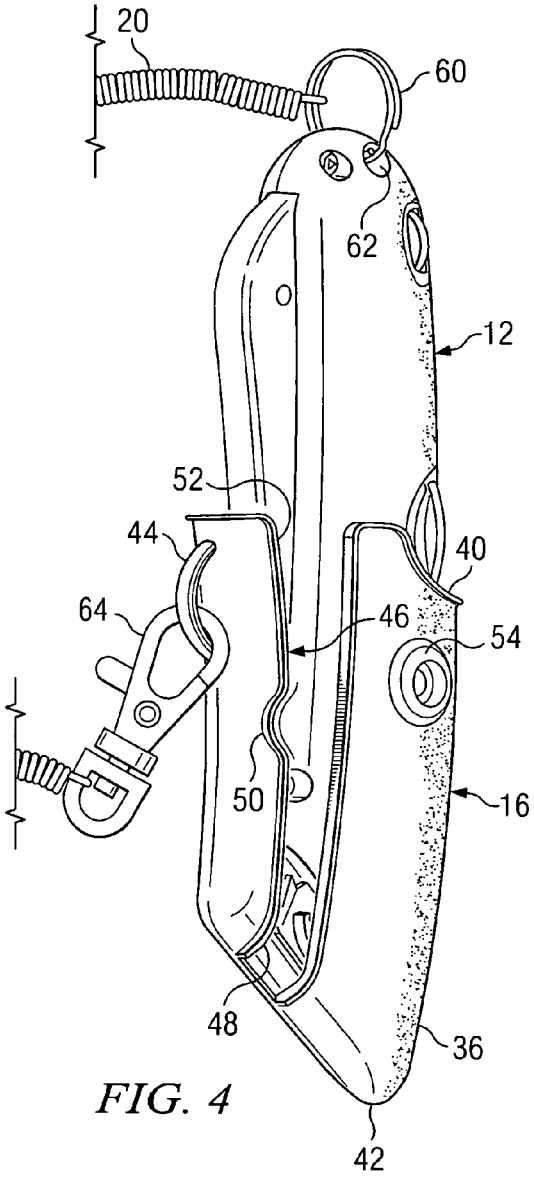
FIGS. 4 and 5 are perspective views of the box cutter fully inserted into the holster.
Figure 5:
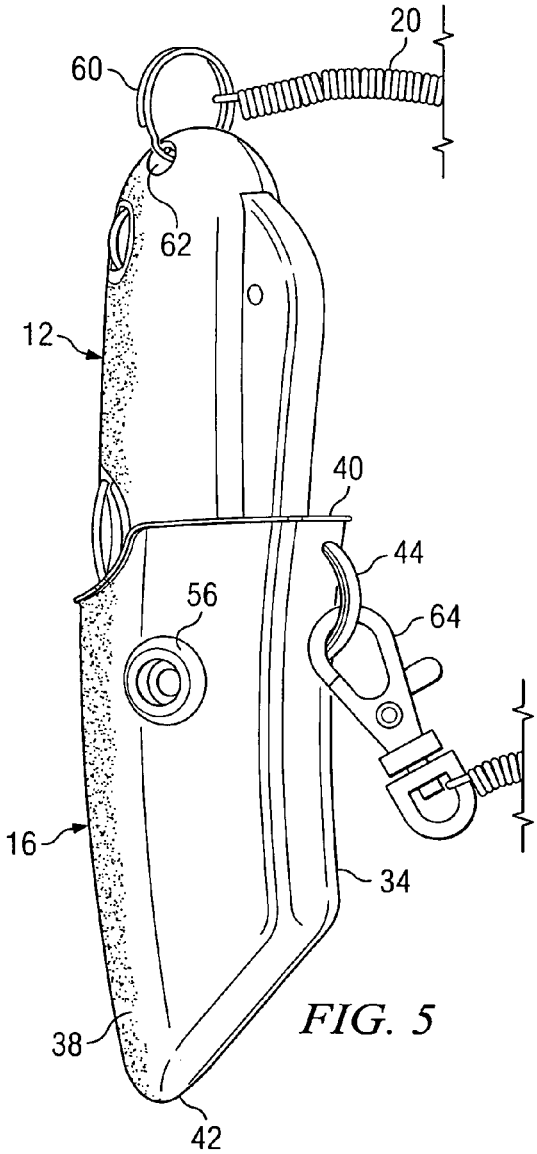
Figure 6:
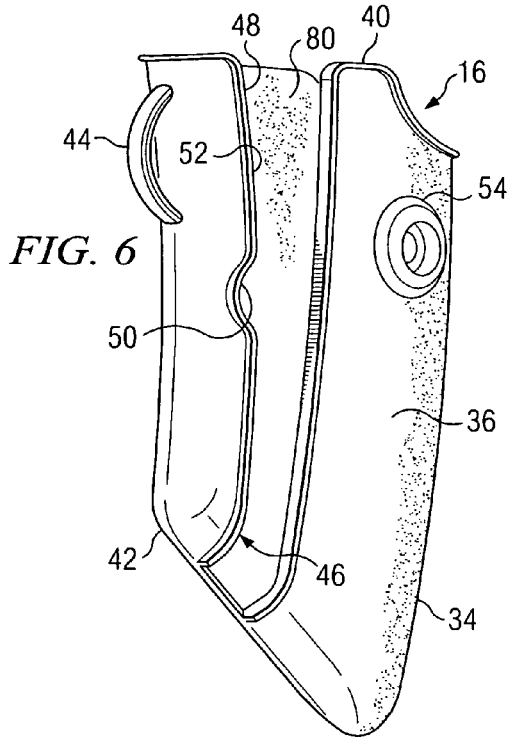
FIGS. 6 and 7 are side elevation views of the holster.
Figure 7:
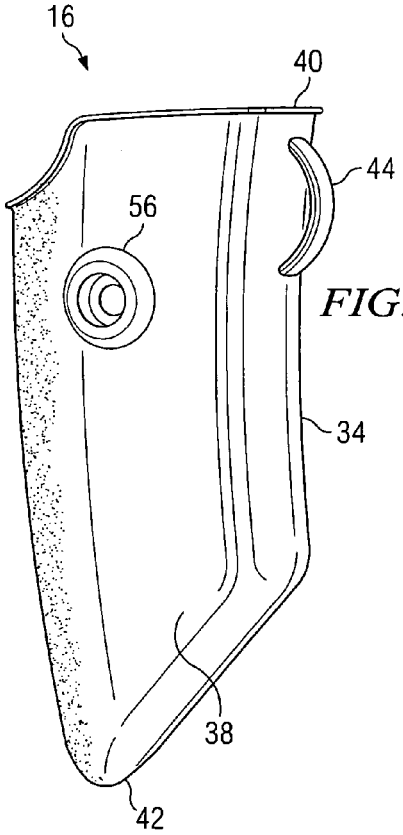
Figure 8:
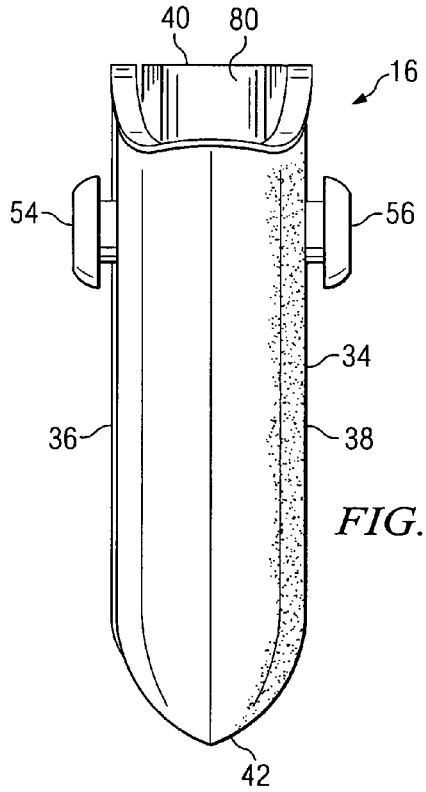
FIG. 8 is a front elevation view of the holster.
Figure 9:
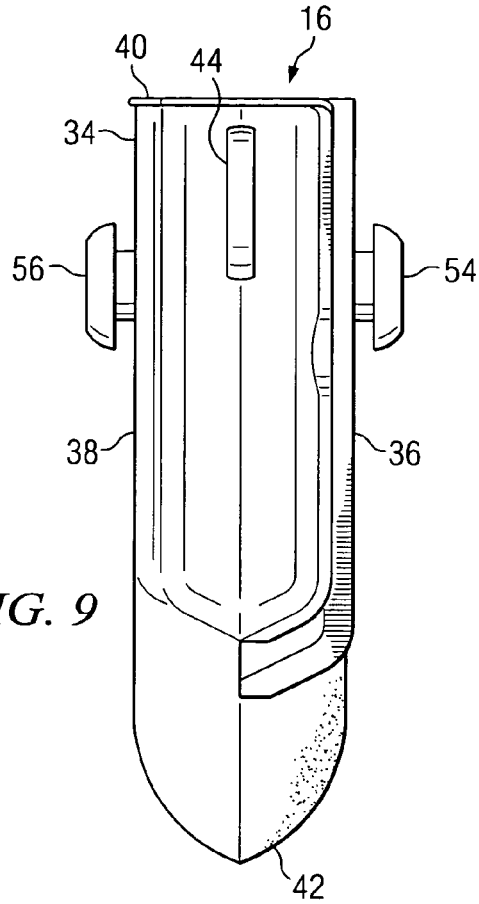
FIG. 9 is a rear elevation view of holster.
Figure 10:
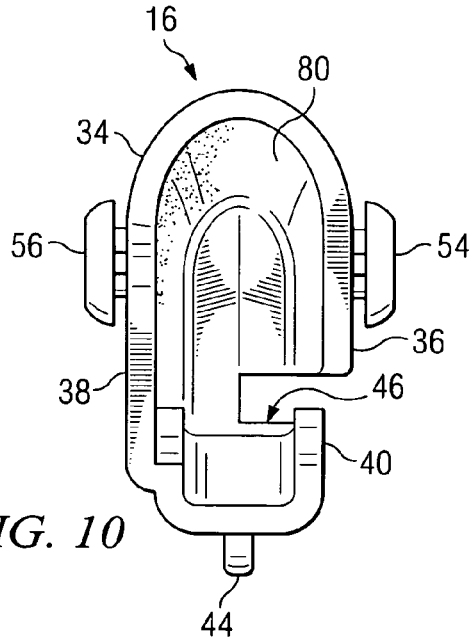
FIG. 10 is a top elevation view of the holster.
Figure 11:
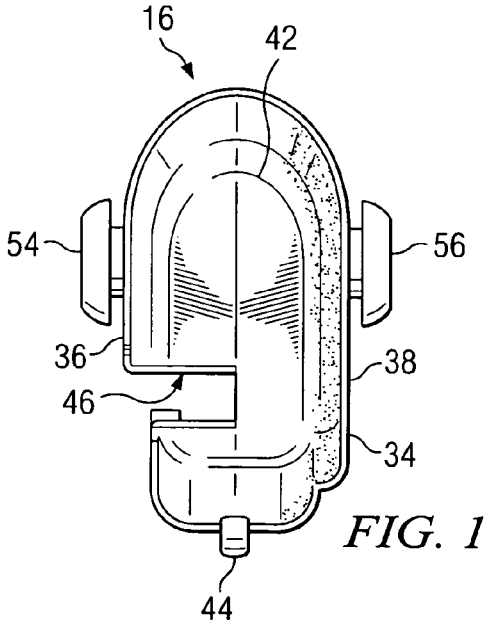
FIG. 11 is a bottom elevation view of the holster.
Figure 12:
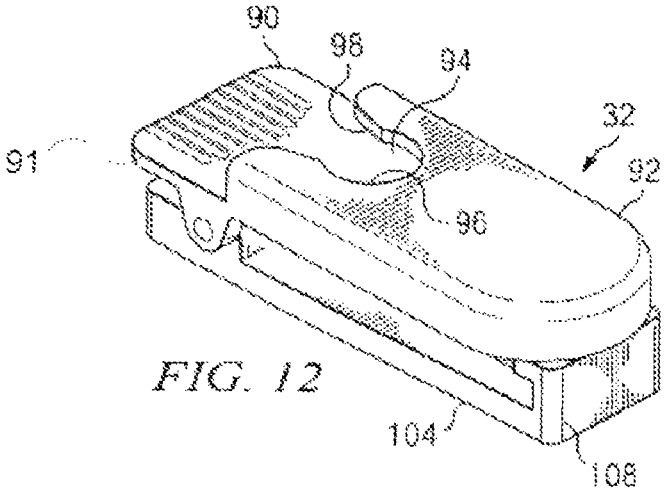
FIG. 12 is a perspective view of the belt clip.
Figure 13:
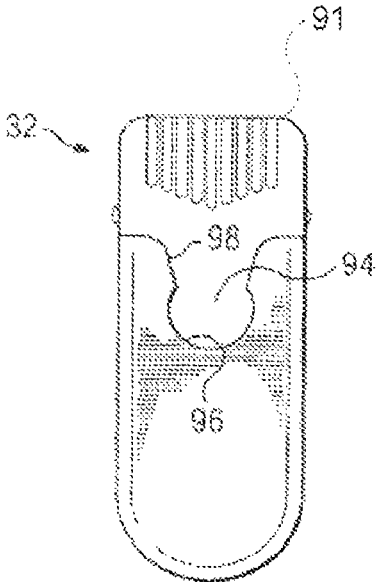
FIG. 13 is a top elevation view of the belt clip.
Figure 14:
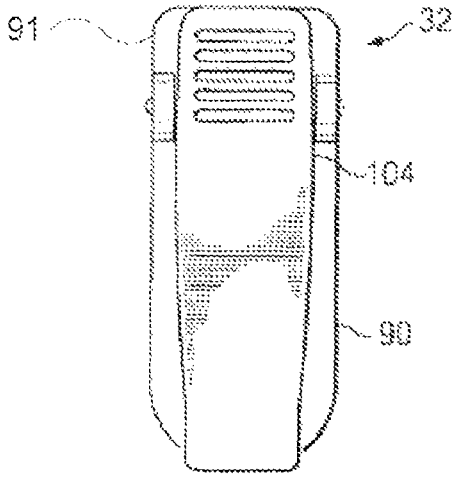
FIG. 14 is a bottom elevation view of the belt clip.
Figure 15:
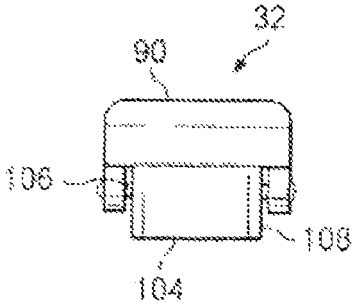
FIG. 15 is a front elevation view of the belt clip.
Figure 16:
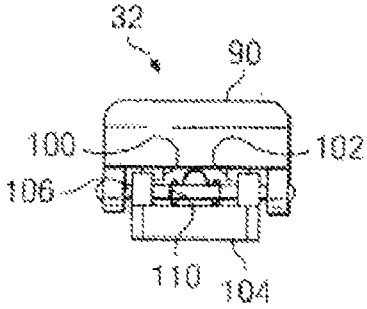
FIG. 16 is a rear elevation view of the belt clip.

More specifically, as the box cutter 12 is moved in the direction of arrow 70, a flared tang member 72, which is best seen in FIG. 2, formed on the box cutter 12 slides along the shoulder 48 of the holster 16. The flared tang member 72 causes the shoulder 48 to deflect slightly as the nose of the box cutter 12 is inserted. This deflection continues until the flared tang member 72 falls into the detent 50 at the limit of insertion as depicted in FIGS. 4 and 5. It should be appreciated that the flared tang member 72 complements the shape of the holster 16 and different sizes and shapes of flared tang members are within the teachings of the present invention.

FIGS. 4 and 5 depict the box cutter 12 fully inserted into the holster 16. The "snap fit" retaining feature described in FIG. 3 prevents the box cutter 12 from falling out of the holster 16 when fully inserted. The flared tang member 72 yieldably opposes retraction of the box cutter 12 and the operator 14 must exercise enough force to overcome the detented engagement to remove the box cutter 12 from the holster 16.

FIGS. 6 through 11 depict the holster 16 in further detail. As previously discussed, a body 34 having sidewalls 36 and 38, which define an inner channel 80, substantially conform to the shape of a box cutter 12 for appropriate acceptance of the box cutter 12. The loop 44 is positioned at the interface of sidewalls 36 and 38 to accept the lanyard 20 or other attachment device. Also, as previously discussed, the body 34 includes an open top end 40 for the insertion and removal of the box cutter 12 as well as a closed bottom end 42 for housing the inserted box cutter 12.

The elongated slot 46 is formed in the sidewall 36 and includes a shoulder 48 and detent 50 formed on an edge portion thereof. Coupling studs 54 and 56 for engaging the belt clip 32 are mounted on the sidewalls 36 and 38, respectively. As will be discussed in further detail herein, the coupling studs 54 and 56 of the holster laterally offset the attachment of the belt clip 32 to provide clear access by the operator to the holster 16.

FIGS. 12 through 16 depict the belt clip 32, which may be considered a belt clip assembly, in further detail. A base member 90 releasably and slidably engages the holster 16. In particular, a plate 92 is superposed on the base member 90 to form a housing 94 having a slot 96 and a neck 98 that provide an interference or snap fit for engagement by either of the coupling studs 54 and 56 of the holster 16. Transverse shoulders 100 and 102, which are best seen in FIG. 17, are formed on an underside of the base member 90 to compress the belt 18 against a clip member 104.

The clip member 104 is hingedly connected to the base member 90 by rod 106. In one embodiment, the clip member 104 includes a U-shaped end portion 108 generally conforming to the shape of the bottom edge of the belt 18. A spring 110 biases the clip member 104 to the base member 90. The belt 18 is captured within the U-shaped end portion 108 of the belt clip 32 and against the shoulders 100 and 102 in order to stabilize against sliding movement along the belt 18.

Figure 17:
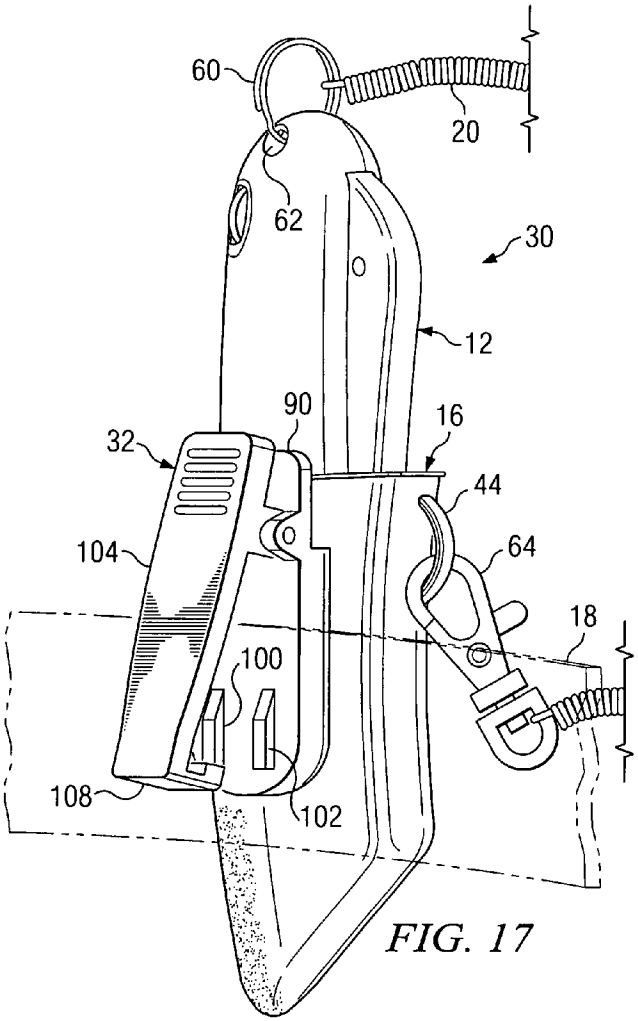
FIG. 17 is a perspective view of the holster assembly engaging a belt of the operator.

FIG. 17 depicts the holster assembly 30 engaging the belt 18 of the operator 14 on the operator's right hand side. For purposes of explanation, the belt is ghosted in FIG. 17. Additionally, as previously discussed, the holstering system 10 described herein provides for carrying of the box cutter 12 on either the left or right side of the operator 13.

In operation, the holster 16 is secured to the belt 18 by use of the belt clip 32. More specifically, the base member 90 is positioned against the inside of the belt 18 and the clip member 104 is simultaneously positioned on the outside of the belt 18. The base member 90 and clip member 104 of the belt clip 32 act as spring biased jaws for clamping engagement against the belt 18.

Figure 18:
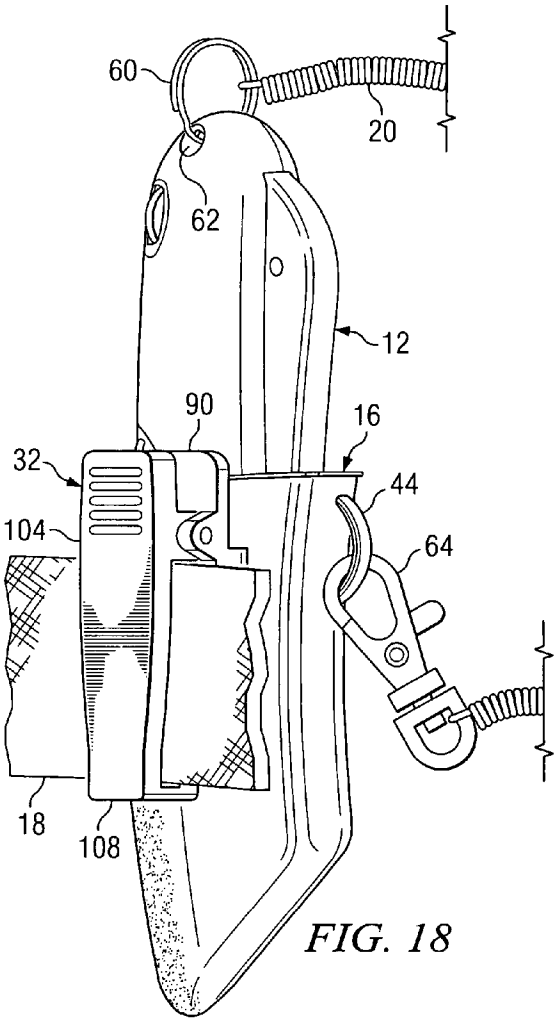
FIG. 18 is a perspective view of the holster assembly secured to the belt of the operator.

As depicted in FIG. 18, once the belt clip 32 is clamped to the belt 18, the belt clip 32 provides for stabilizing against sliding movement along the belt 18. The U-shaped end portion 108 captures the bottom edge of the belt 18 and the shoulders 100 and 102 compress the belt 18 against the clip member 104 of the belt clip 32. As previously discussed, this stabilizes the holster assembly 30 on the operator 14 and opposes sliding movement of along the belt 16. Further, as illustrated in FIG. 18, the belt clip 32 laterally offsets the holster 16 for clear and easy operator hand-grip access to the box cutter 12.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

I claim:

1. A holstering system for a utility knife comprising, in combination:

a holster for releasably retaining a utility knife, the holster having a body substantially conforming to the shape of an end portion of a handle of the utility knife, an open top end and a bottom end, the holster comprising means for yieldably opposing insertion of the end portion of the handle of the utility knife into the holster, the holster further comprising an interior channel adapted to releasably secure the utility knife within the holster;

a lanyard having a first end portion coupled to the holster and a second end portion adapted for attachment to the utility knife; and a clip releasably coupled to the holster and adapted to attach the holster to a belt of an operator, wherein the means for yieldably opposing insertion of the end portion of the handle of the utility knife into the holster comprises a slot comprising an opening formed through the body and extending in the body from at or near the open top end to at or near the bottom end, the slot comprising a detent adapted to engage a flared tang disposed on the handle of the utility knife.

2. The holstering system as recited in claim 1, wherein the lanyard is adapted to limit the drop of the utility knife after its removal from the holster.

3. The holstering system as recited in claim 1, wherein the interior channel substantially conforms to a contoured exterior of the handle of the utility knife.

4. The holstering system as recited in claim 1, further comprising first coupling means disposed on the left hand side of the holster and second means disposed on the right hand side of the holster for releasably securing the belt clip to the holster.

5. The holstering system as recited in claim 1, wherein the lanyard is extendable and retractable in length.

6. The holstering system as recited in claim 1, wherein the lanyard comprises a swivel device that permits the lanyard to rotate independently of the holster.

7. The holstering system as recited in claim 1, wherein the clip includes a body portion adapted to laterally offset the holster from the belt to provide operator hand-grip access to the utility knife received in the holster.

8. The holstering system as recited in claim 1, the clip further comprising means for releasably engaging a belt and opposing sliding movement of the clip along the belt.

9. The holstering system as recited in claim 1, wherein the holster further comprises a sliding interface engagement adapted to releasably secure the utility knife within the holster without locking engagement of the utility knife with the holster when the end portion of the handle abuts the bottom end of the holster.

10. A utility knife and holstering assembly, comprising in combination:

a utility knife comprising a handle and a blade, the blade at least partially enclosable within the handle;

a holster having a first sidewall portion and a second sidewall portion defining a pocket for receiving at least a portion of the handle of the utility knife, the holster comprising an elongated slot comprising an opening formed through the first sidewall portion and extending from at or near an open top end of the holster to at or near an at least partially enclosed bottom end of the holster, the first sidewall portion having a shoulder formed along the slot and disposed for sliding interference engagement with the portion of the handle of the utility knife during insertion, the slot adapted to slidably receive the portion of the handle during insertion of the utility knife into the holster; and a lanyard having a first end portion coupled to the holster and a second end portion coupled to the utility knife, wherein the first sidewall portion is adapted to deflect outwardly transverse to the slot during insertion, thereby yieldably opposing insertion of the portion of the handle of the utility knife into the holster and the elongated slot adapted to releasably secure the utility knife within the holster.

11. The utility knife and holstering assembly as recited in claim 10, further comprising:

a first coupling stud mounted on the first sidewall portion; and a second coupling stud mounted on the second sidewall portion;

wherein each of the first and second coupling studs is operable to releasably engage a belt clip, thereby permitting the holster to be worn on the left hand side and on the right hand side of an operator.

12. The utility knife and holstering assembly as recited in claim 10, the first sidewall portion having a shoulder formed along the slot and the shoulder having a detent formed thereon for receiving a flared portion of the handle of the utility knife as the utility knife traverses the shoulder during insertion, thereby providing detented engagement between the portion of the handle of the utility knife and the holster at the limit of insertion, and yieldably opposing retraction of the portion of the handle of the utility knife from the holster.

13. The utility knife and holstering assembly as recited in claim 10, further comprising a belt clip including:

a base member for releasably engaging the holster;

a clip member hingedly connected to the base member, the clip member having a U-shaped end portion substantially conforming to the shape of the bottom edge of the belt; and a spring for biasing the clip member to the base member so as to hold the belt clip assembly to the belt and capture the belt within the U-shaped end portion to oppose sliding movement of the clip along the belt.

14. A holster comprising:

a first sidewall portion and a second sidewall portion defining a pocket for receiving at least a portion of a handle of a utility knife, the first sidewall portion adapted to deflect radially upon insertion of the portion of the handle into the holster, thereby yieldably opposing insertion of the portion of the handle of the utility knife into the holster;

a first coupling stud mounted on the first sidewall; and a second coupling stud mounted on the second sidewall, wherein the first coupling stud and the second coupling stud are operable to slidably engage a belt clip, thereby permitting the holster to be worn on the left hand side and right hand side of an operator, wherein the holder further comprises an elongated slot comprising an opening formed through the first sidewall portion, and extending from at or near the open to end of the holster to at or near an at least partially enclosed bottom end of the holster, the elongated slot having a shoulder and a detent formed thereon for receiving a flared portion of the handle of the utility knife as the utility knife traverses the shoulder during insertion, thereby providing detented engagement between the portion of the handle of the utility knife and the holster at the limit of insertion, and yieldably opposing retraction of the portion of the handle of the utility knife out of the holster.

15. The holster assembly as recited in claim 14, wherein the shoulder is formed along the slot and disposed for sliding interference engagement with the portion of the handle of the utility knife during insertion.

16. A holster for use in conjunction with a box cutter, the holster comprising:

a holster body having a first sidewall portion and a second sidewall portion defining a pocket for receiving at least a portion of a handle of the box cutter; and an elongated slot comprising an opening formed through the first sidewall and extending from at or near an open top end of the holster to at or near an at least partially enclosed bottom end of the holster, the elongated slot having a shoulder portion and a detent formed on an edge portion thereof, the shoulder portion being disposed for sliding interference engagement with the portion of the handle of the box cutter during insertion of the box cutter into the pocket such that a flared tang member formed on the box cutter traverses the shoulder in a sliding interference engagement, and the flared tang member moves into the detent at the limit of insertion, wherein the engagement of the flared tang member in the sidewall detent yieldably opposes retraction of the box cutter out of the holster when the flared tang member moves into the detent at the limit of insertion.

17. The holster as recited in claim 16, wherein the first sidewall portion is adapted to provide sliding interference engagement with the portion of the box cutter and deflect radially during insertion, thereby yieldably opposing insertion of the portion of the box cutter into the holster.

18. The holster as recited in claim 16, further comprising a belt clip assembly, the belt clip assembly comprising:

a base member for releasably engaging the holster, the base member comprising a tab member at an end of the base member;

a clip member hingedly connected to the base member, the clip member having a U-shaped end portion generally conforming to the shape of an edge portion of a belt; and a spring urging the clip member toward the base member so as to hold the belt clip assembly to the belt and capture the belt within the U-shaped end portion, thereby opposing sliding movement of the clip along the belt, wherein the spring rotates to release the belt from within the U-shaped end portion of the clip member upon actuation of the tab member to adjust the base member away from the clip member.

* * * * *

UNITED STATES PATENT AND TRADEMARK OFFICE

CERTIFICATE OF CORRECTION

PATENT NO. : 8,322,586 B2
APPLICATION NO. : 11/228915
DATED : December 4, 2012
INVENTOR(S) : Raymond E. Davis It is certified that error appears in the above-identified patent and that said Letters Patent is hereby corrected as shown below:

Column 6, Line 60, in Claim 14, delete “to” and insert -- top --

Signed and Sealed this
Fifth Day of March, 2013

Teresa Stanek Rea
*Acting Director of the United States Patent and Trademark Office*